United States Patent [19]

Lehmann

[11] 4,303,018

[45] Dec. 1, 1981

[54] CONVERTIBLE TABLE

[76] Inventor: Edmund J. Lehmann, 481 Huron St., Box 576, New Hamburg, Ontario, Canada, N0B 2G0

[21] Appl. No.: 98,675

[22] Filed: Nov. 29, 1979

[51] Int. Cl.[3] ..... A47B 9/00

[52] U.S. Cl. ..... 108/12; 108/145; 108/150

[58] Field of Search ..... 108/12, 17, 16, 18, 108/144, 145, 150, 128; 248/421; 297/337, 338, 345

[56] References Cited

U.S. PATENT DOCUMENTS

| | | | |
|---|---|---|---|
| 483,777 | 10/1892 | Bredsvold | 248/422 X |
| 862,791 | 8/1907 | Bawden et al. | 108/145 |
| 2,520,789 | 8/1950 | Weiss | 108/145 |
| 2,729,274 | 1/1956 | Boschetti et al. | 297/338 |
| 4,089,147 | 5/1978 | Bain | 248/421 |

FOREIGN PATENT DOCUMENTS

| | | | |
|---|---|---|---|
| 588685 | 2/1925 | France | 108/145 |

*Primary Examiner*—Francis K. Zugel
*Attorney, Agent, or Firm*—Sim & McBurney

[57] ABSTRACT

A convertible table which is moveable from a high position to a low position and vice-versa may function, for example as a dining table and as a coffee or lounge table. The tabletop is supported by a centrally located leg extending between the table top and the base of the table. The table leg includes at least three outwardly collapsible walls each including an upper panel and a lower panel, these panels being hinged together and to the table top and base respectively. In the high position of the table and panels are biased into alignment with one another and a device is provided to move at least one of each of the panels of each pair of panels outwardly against the biasing force to permit the walls constituting the central table leg to collapse.

9 Claims, 6 Drawing Figures

CONVERTIBLE TABLE

Figure 1:
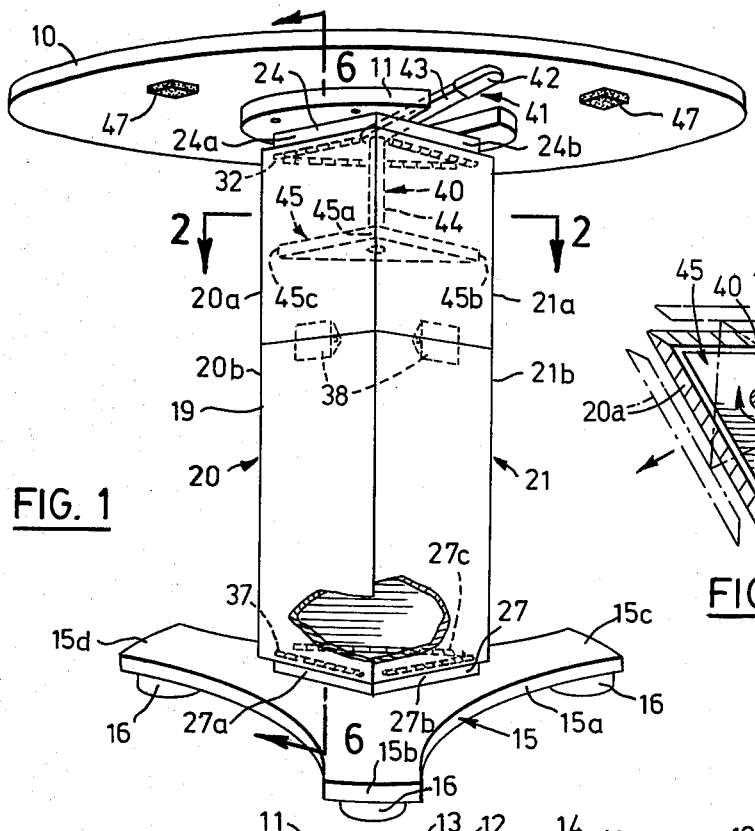

This invention relates generally to a convertible table for use interchangeably as a high table and a low table, e.g. as a dining table and a coffee or lounge table.

Many forms of high-low convertible tables or similar devices are already known, and the following patents are exemplary in this respect:

U.S. Pat. No. 3,245,366, Martin Fox, Apr. 12, 1966
U.S. Pat. No. 2,678,858, Mansell A. Davis, May 18, 1954
U.S. Pat. No. 2,582,791, Earl L. Page, Jan. 15, 1952
U.S. Pat. No. 2,532,766, Paul Francois Galleret, Dec. 5, 1950
U.S. Pat. No. 2,531,233, John H. Pettit, Nov. 21, 1950
U.S. Pat. No. 2,520,789, Hans Weiss, Aug. 29, 1950
U.S. Pat. No. 581,486, A. Monkiewicz, Apr. 27, 1897

The prior art represented by the above-mentioned patents includes several structures adapted to be adjusted from a position where the elevated table top is shifted to a lowered position, thereby converting the table into a lower table. The Weiss U.S. Pat. No. 2,520,789 is a representative patent in this regard. For the most part the convertible tables disclosed in the aforementioned patents have legs spaced around the perimeter of the table, the legs being designed to collapse inwardly. Legs so arranged impose limits on the number of chairs that can be placed around a table.

It is an object of an aspect of this invention to provide a table which has an outwardly collapsible center leg and which may be readily shifted from a higher elevation to a lower elevation and vice-versa, thereby providing a sturdy table having its top at a height characteristic of a dining table or the like, which can be converted to a lower position, thereby providing a sturdy table having its top at a height characteristic of a coffee or lounge table.

An object of an aspect of the invention is to provide a table having a narrow center leg which is collapsible outwardly, thereby permitting a wide difference in the range of the heights of the table in the lower and higher positions and further permitting maximum accessibility for dining, for seating comfort and for the placement of chairs around the perimeter of the table.

An object of an aspect of the invention is to provide a base member for the collapsible leg which itself permits maximum accessibility for dining, for seating comfort and for the placement of chairs around the perimeter of the table.

An object of an aspect of the invention is to provide a table wherein the weight of the top and of associated parts holds said structure collapsed when the table is in the lower position and wherein there are spring mechanisms which secure the table in its high position.

An object of an aspect of the invention is to provide a table wherein there is a release mechanism operable when the table is in the higher position which is very simple to operate. This release mechanism is a single rotatable element which is mounted on a handle mechanism which, when the handle mechanism is operated, makes part of a rotation, thereby pressing against the upper panels of the centre leg walls disengaging the spring mechanisms to allow the shift of the table to the lower position.

Accordingly this invention in one aspect provides:

A table having a variable height and comprising a table top; a base member; a table leg interposed between said base member and said table top and supporting said table top, said table leg comprising at least three outwardly collapsible walls, each of said walls including an upper panel having upper and lower ends and a lower panel having upper and lower ends; means pivotally connecting said lower end of each of said upper panels and said upper end of each of said lower panels; means pivotally connecting said upper end of each of said upper panels to said table top and said lower end of each of said lower panels to said base member; means biasing each pair of upper and lower panels into alignment with each other; whereby each said pair forms a rigid but collapsible vertical, table top supporting wall and means for moving at least one panel of each of the pairs of upper and lower panels outwardly against the force of said biasing means to permit said walls to collapse outwardly away from each other whereby said table top may be moved from a high to a low position.

Figure 2:
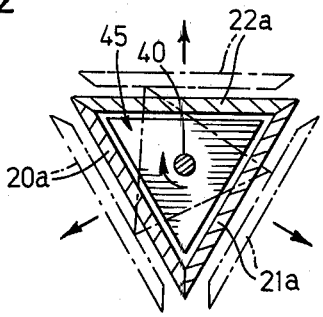
Figure 3:
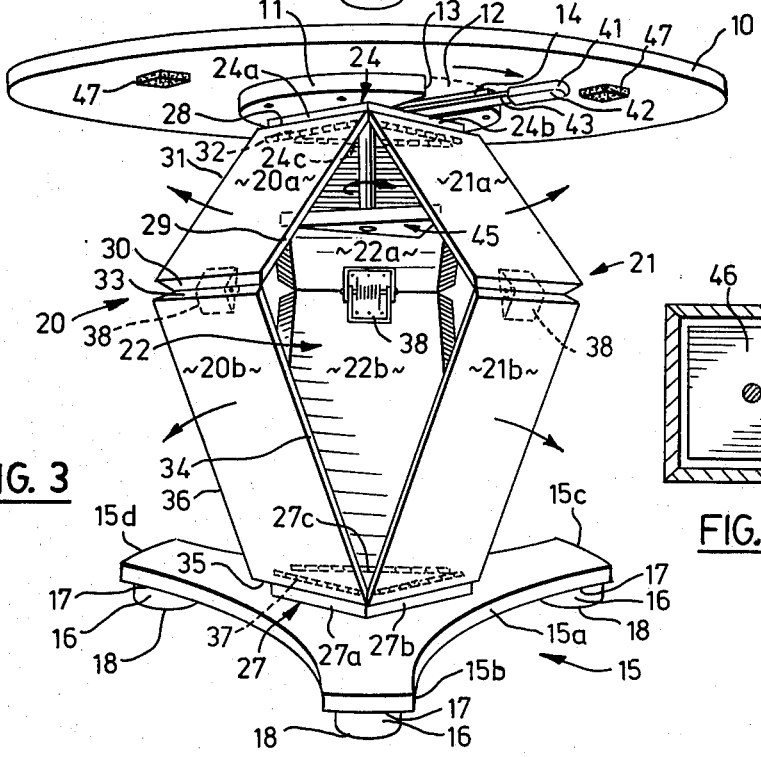
Figure 4:
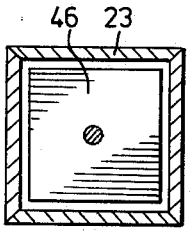
Figure 5:
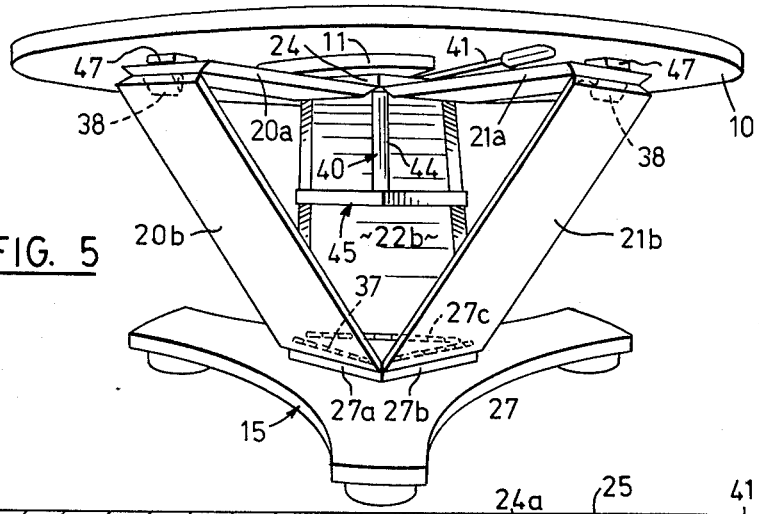
Figure 6:
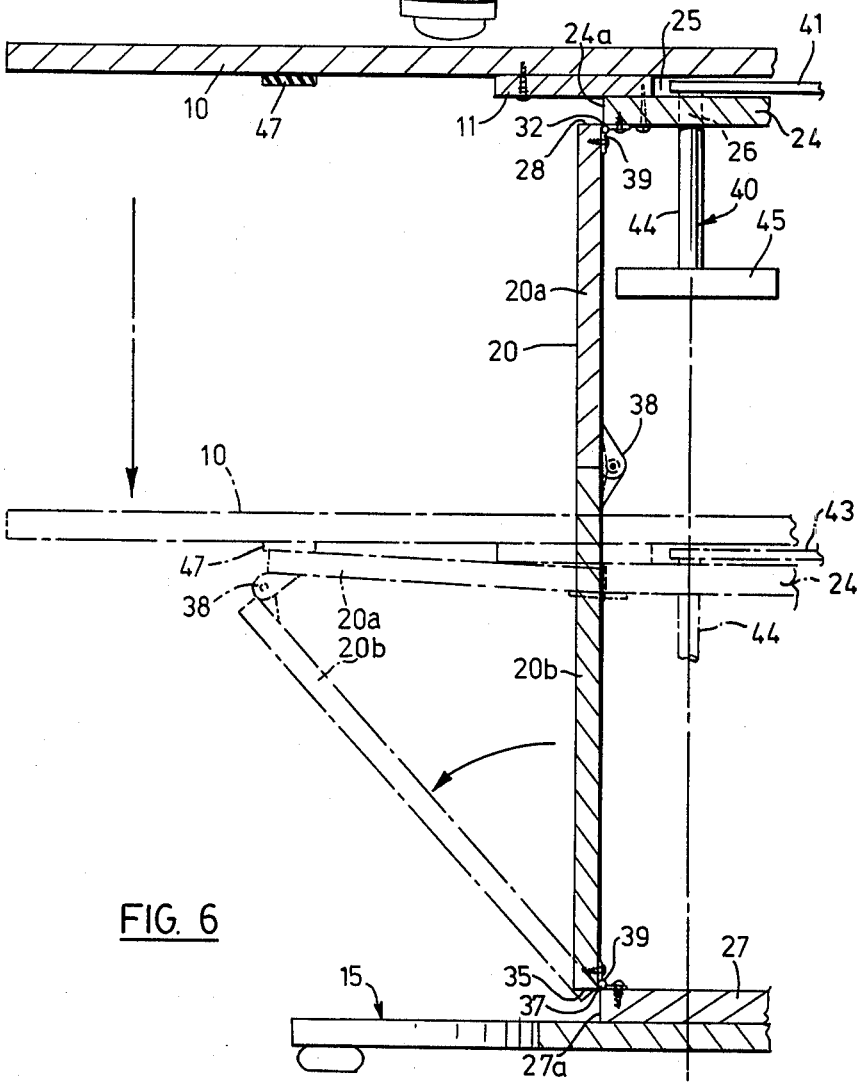

One embodiment of this invention is illustrated in the accompanying drawings, in which like numerals denote like parts throughout the several views, and in which:

FIG. 1 is a perspective view, partly broken away, of the convertible table in the dining position, FIG. 2 is a cross-sectional view of the table leg and plate element along line 2—2 in FIG. 1, with a superimposed view of the same when the plate element has been rotated, FIG. 3 is a perspective view of the convertible table midway between the dinning position and the coffee or lounge position, FIG. 4 is a cross-sectional view of the table leg and plate element, alternatively demonstrating four-sided arrangements of both, FIG. 5 is a perspective view of the convertible table in the coffee or lounge position, and FIG. 6 is a cross-sectional view of a portion of the table taken along line 6—6 in FIG. 1, in the dining position (in solid lines) with a superimposed view of the table in the coffee or lounge position (in dash/dot lines).

Turning now to the figures, the table has a top 10, which is a conventional, one-piece, round table top. However, top 10 could be of any shape, size or weight. Mounted centrally on the top 10 at the underside thereof is a flat, round plate-like member 11 having a V-shaped cleft 12 extending from the outer perimeter of member 11 to the center. The cleft 12 has two side walls 13 and 14 formed by plate-like member 11 and is sufficiently wide to permit the movement of a handle member 41 in a horizontal plane.

The table has a base member 15 which includes a one-piece, Y-shaped flat support platform 15*a*. At the outer limits of the underside of each of the three arms 15*b*, 15*c*, 15*d* of the support platform 15*a* is a thick disc member 16 having one of its flattened sides 17 attached to the base member and having its other flattened side 18 used for placement on the floor. Base member 15 may assume other forms, of course.

The table has a central leg 19 interposed between table top 10 and base member 15 which is composed of a plurality of collapsible walls 20, 21 and 22. In the accompanying drawings these walls are arranged in a triangular configuration, but this configuration is not essential; there could be 4, 5, 6 etc. walls. FIG. 4 shows an alternative 4-sided leg 23. However the remaining description shall presume the triangular shaped leg 19.

Within leg 19 is a triangular upper member 24 which is secured to the plate-like member 11 and positioned approximately in the middle thereof covering part of cleft 12, thereby forming a channel 25 for housing handle member 41 between the underside of the table top 10, the walls 13 and 14 of the cleft 12 and the upperside of member 24. Member 24 has a central opening 26 extending into channel 25. The top member 24 has three outer edges 24*a*, 24*b* and 24*c*. Further top member 24 preferably is of a thickness at least equal to the thickness of each of collapsible walls 20, 21 and 22.

Within table leg 19 is a fixed, triangular, lower member 27 which is secured to the upper side of base member 15 approximately in the center of base member 15. The bottom member 27 has three outer edges, 27*a*, 27*b* and 27*c*.

Each of the three walls 20, 21 and 22 of table leg 19 has elongated upper and lower panels, 20*a* and 20*b*, 21*a* and 21*b*, and 22*a* and 22*b* respectively. These three pairs of panels are identical, so a description of the pair of panels 20*a* and 20*b* will suffice as a description of all three pairs. Upper panel 20*a* is identical to lower panel 20*b* except that lower panel 20*b* is longer than upper panel 20*a*. Panel 20*a* has two ends 28 and 30 and two sides 29 and 31 and an inner edge 32 on the end 28 (see FIG. 6). Panel 20*b* has two ends 33 and 35 and two sides 34 and 36 and an inner edge 37 on end 35 (see FIG. 6). Sides 34 and 36 are longer than sides 29 and 31. At end 30 panel 20*a* meets and is connected to end 33 of panel 20*b*. At this junction there is a conventional spring hinge 38 which is located within the hollow interior of leg 19. When the upper and lower panels 20*a* and 20*b* are vertically disposed, spring hinge 38 retains the table in a raised position by biasing ends 30 and 33 inwardly toward the center of leg 19. As a result, upper and lower panels 20*a* and 20*b* form a rigid but collapsible vertical, table top supporting wall 20. Other means for biasing upper and lower panels 20*a* and 20*b* could be employed without departing from the invention.

The inner edge 32 of end 28 on upper panel 20*a* meets and is connected to the outer edge 24*a* of upper member 24. At this junction there is a conventional butt-hinge 39 which is located within the hollow interior of leg 19. Upper member 24 preferably is of a thickness sufficient to permit the pivoting of the upper panel 20*a* at hinge 39 so that upper panel 20*a* and upper member 24 can be in substantially horizontal alignment when the table is in the lower portion (see FIG. 6).

The inner edge 37 of end 35 on lower panel 20*b* meets and is connected to the outer edge 27*a* of lower member 27. At this junction there is a conventional butt-hinge 39 which is located within the hollow interior of leg 19. Lower member 27 is of a thickness sufficient to permit the pivoting of the lower panel 20*b* at butt-hinge 39 to the extent required to permit the table top to be lowered to the desired level.

Turning now to the release mechanism, which is generally designated 40, this includes a handle member 41 which consists of a flat shaft 43 and a grip 42. Shaft 43 is attached to a cylindrical rod 44 and is substantially at right angles to the rod 44. Rod 44 passes through opening 26 in upper member 24 and is attached to a single triangular plate element 45. If the leg 19 had 4,5,6 etc. walls, as mentioned above, the plate element 45 would have a corresponding number of edges. A rectangular plate element 46 is shown in FIG. 4. When the table is in the dining position, the plate element 45 fits snugly within the hollow triangular space defined by upper panels 20*a*, 21*a* and 22*a* of collapsible walls 20, 21 and 22, with the apices 45*a*, 45*b* and 45*c* of the plate element 45 aligned with the apices of the triangle formed by walls 20, 21 and 22.

The three pairs of panels, 20*a* and 20*b*, 21*a* and 21*b*, 22*a* and 22*b*, are all similarly inter-hinged and hingedly attached to the upper member 24 and the lower member 27. When the table is in the dining position, movement of handle member 41 horizontally within cleft 12 will cause the plate element 45 to rotate. The apices of plate 45 will strike the upper panels of the walls of leg 19, as follows: apex 45*a* will strike panel 21*a*, apex 45*b* will strike panel 22*a* and apex 45*c* will strike panel 20*a*. This striking of the upper panels combined with the weight of table top 10 will be sufficient to cause the three spring hinges 38 to buckle and butt-hinges 39 to pivot. The walls 20, 21 and 22 will collapse until the upper and lower panels of each are in a bowed position. In this bowed position the upper and lower panels of each wall will be at approximately a 45° angle to each other in the embodiment illustrated. Table top 10 will rest against upper panels 20*a*, 21*a* and 22*a*. Felt pads 47 can be placed at the perimeter of the underside of table top 10 so that the upper panels 20*a*, 21*a* and 22*a* make contact with the pads when the table is in the lower position. The weight of the table top and the other parts will keep the table in this lower position as shown in FIG. 5.

When it is desired to move the table to the high position, it is necessary only to pull up on the table top 10 until the upper and lower panels of walls 20, 21 and 22 become vertically disposed. Spring hinge 38 will maintain the table in the dining position.

I claim:

1. A table having a variable height and comprising a table top; a base member; a table leg interposed between said base member and said table top and supporting said table top, said table leg comprising at least three outwardly collapsible walls, each of said walls including an upper panel having upper and lower ends and a lower panel having upper and lower ends; pivotally connecting said lower end of each of said upper panels and said upper end of each of said lower panels; means pivotally connecting said upper end of each of said upper panels to said table top and said lower end of each of said lower panels to said base member; means biasing each pair of upper and lower panels into alignment with each other, whereby each said pair forms a rigid but collapsible vertical table top supporting wall; and means for moving at least one panel of each of the pairs of upper and lower panels outwardly against the force of said biasing means to permit said walls to collapse outwardly away from each other whereby said table top may be moved from a higher to a low position.

2. A table according to claim 1 wherein said means pivotally connecting said lower end of each of said upper panels and said upper end of each of said lower panels and said means pivotally connecting said upper end of each of said upper panels to said table top and said lower end of each of said lower panels to said base member comprise hinge means.

3. A table according to claim 2 wherein said biasing means comprises spring means biasing said hinge means connecting said upper and lower panels.

4. A table according to claim 1 wherein said table leg is centrally located with respect to said table top and is the sole support for said table top.

5. A table according to claim 1 wherein there are three of said walls and said walls are arranged in triangular configuration.

6. A table according to claim 1 wherein there are four of said walls and said walls are arranged in rectangular configuration.

7. A table according to claim 1 wherein said moving means comprises a rotatable member within said walls shaped such that when said upper and lower panels are aligned said member in a first position thereof is spaced from said walls but in a second position thereof contacts said walls and moves said walls outwardly, and means for rotating said member from said first position to said second position thereof.

8. A table according to claim 6 wherein there are three of said walls and said walls are arranged in triangular configuration, said rotatable member also being of triangular configuration.

9. A table according to claim 1 wherein said upper panels are shorter than said lower panels whereby said table top, when said table is in said low position, rests on said upper panels of the collapsed walls.

* * * * *